US005685137A

United States Patent [19]

Raasch

[11] Patent Number: 5,685,137

[45] Date of Patent: Nov. 11, 1997

[54] FIBER GUIDE CONDUIT IN AN OPEN-END SPINNING UNIT

[75] Inventor: Hans Raasch, Mönchengladbach, Germany

[73] Assignee: W. Schlafhorst AG & Co., Moenchengladbach, Germany

[21] Appl. No.: 618,282

[22] Filed: Mar. 18, 1996

[30] Foreign Application Priority Data

Mar. 25, 1995 [DE] Germany ..... 195 11 084.6

[51] Int. Cl.[6] ..... D01H 4/00

[52] U.S. Cl. ..... 57/413; 57/407; 57/408

[58] Field of Search ..... 57/406, 407, 411, 57/412, 413, 408

[56] References Cited

U.S. PATENT DOCUMENTS

| | | | |
|---|---|---|---|
| 5,111,651 | 5/1992 | Pohn et al. | 57/413 |
| 5,423,172 | 6/1995 | Furtmeier et al. | 57/407 |
| 5,555,717 | 9/1996 | Schuller et al. | 57/406 |

FOREIGN PATENT DOCUMENTS

| | | |
|---|---|---|
| 2 016 469 | 10/1970 | Germany . |
| 23 64 261 A1 | 6/1975 | Germany . |
| 28 00 795 A1 | 7/1979 | Germany . |
| 29 47 294 A1 | 5/1980 | Germany . |
| 39 23 060 A1 | 1/1991 | Germany . |
| 42 29 144 A1 | 3/1994 | Germany . |
| 35 27 943 C2 | 11/1994 | Germany . |
| 1 471 967 | 4/1977 | United Kingdom . |

*Primary Examiner*—William Stryjewski

*Attorney, Agent, or Firm*—Kennedy Covington Lobdell & Hickman, LLP

[57] ABSTRACT

An open-end spinning unit having a one-piece fiber guide conduit inserted between the opening roller housing and the rotor housing is drawn from a steel tube and embodied as an interchangeable component. The fiber guide conduit can be releasably mounted at one end in the opening roller housing in a seating recess and at the other end in the rotor housing in a bore of a sealing plate that is attached to the rotor housing. The sealing plate maintains a low pressure condition created by a vacuum line attached to the rotor housing. This low pressure condition induces the pneumatic conveyance of opened fibers from the opening roller to the rotor through the fiber guide conduit. Sealing components, such as an O-ring in the opening roller housing and a sealing nozzle at the rotor housing assure that a sealed connection of the fiber guide conduit both with the opening roller housing and with the sealing plate is maintained for pneumatic conveyance.

15 Claims, 3 Drawing Sheets

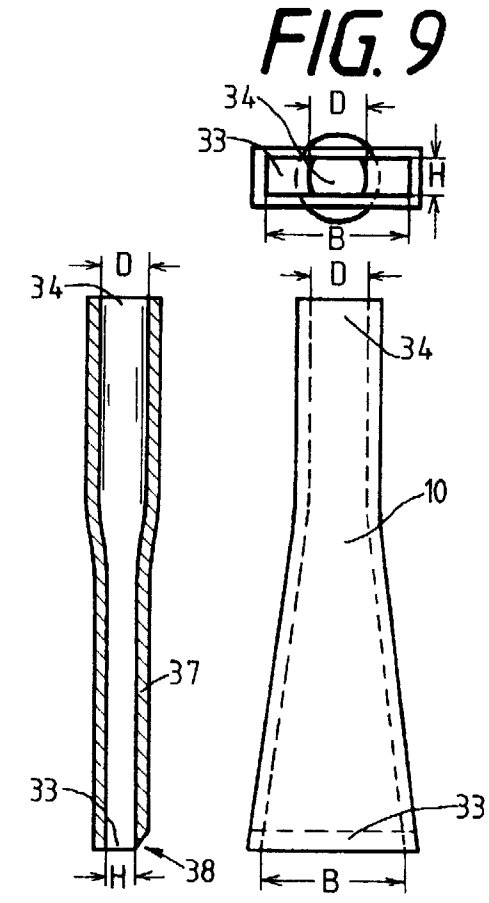
FIG. 9
FIG. 8
FIG. 7
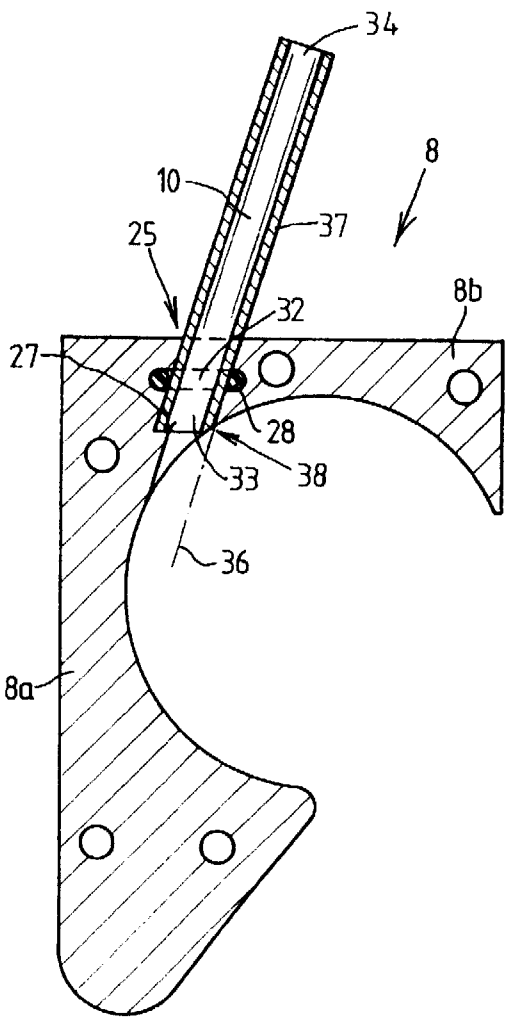
FIG. 6
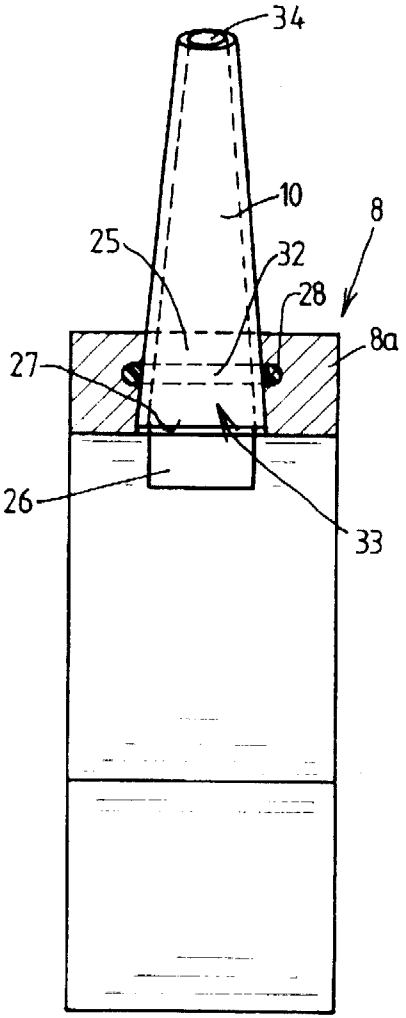
FIG. 5

FIBER GUIDE CONDUIT IN AN OPEN-END SPINNING UNIT

FIELD OF THE INVENTION

The present invention relates to an open-end spinning unit having a spinning rotor rotatably disposed in a rotor housing which can be sealably enclosed by means of a closure plate, a silver opening device having an opening roller rotatably disposed in an opening housing, and a one-piece fiber guide conduit disposed between the silver opening device and the conduit plate.

BACKGROUND OF THE INVENTION

Conventional open-end rotor spinning units are known, for example, from German Patent Publication DE 35 27 943 C2. In a conventional open-end spinning unit, a silver can is placed in front of the open-end spinning unit and silver is fed to the rotating opening roller for opening of the silver into individual fibers. The opened fibers are then conveyed via a one-piece fiber guide conduit into a rotating spinning rotor in which the fibers centrifugally collect in an interior groove and are progressively joined to the trailing end of a yarn leaving the spinning rotor through a draw-off device. The finished yarn is then wound into a cheese on an associated winding device.

Great demands are made on the design of the fiber guide conduit which transports the individual fibers from the opening roller to the spinning rotor, particularly in respect to the surface quality inside of the fiber guide conduit. For instance, the interior surface of the fiber guide conduit must be continuously smooth so that fibers will not become stuck in the course of pneumatic conveyance between the opening roller and the rotor. In addition, a smooth surface is required to prevent the formation of interfering air vortices in the boundary layer area of the fiber guide conduit. Another demand is that the fiber inlet portion of the fiber guide conduit which communicates directly with the opening roller must be capable of enduring significant wear from loosened mineral dust or fibers clinging to the teeth of the rotating opening roller so that the fiber inlet portion of the fiber guide conduit is not damaged.

A two-piece fiber guide conduit is known from German Patent Publication DE 42 29 144 A1, in which the portion of the fiber guide conduit receiving fiber for carrying to the rotor constitutes a part of the opening roller housing itself. The fiber inlet portion of the fiber guide conduit is formed integrally with the opening roller housing as a pressure die cast part typically made from aluminum or zinc. However, in the course of producing such pressure diecast parts, the operating limitations of the pressure die casting tools, as for example the required conicity of the core puller, make the optimization of the die cast parts with respect to spinning technology extraordinarily difficult or impossible.

It has therefore been proposed (see, e.g., German Published, Non-Examined Patent Application DE-OS 28 00 795), first to produce the fiber guide conduit as a sheet steel plate in one manufacturing process, since in this process the requirements regarding surface quality, wear protection and shaping can be better met, and then to subsequently recast the prefabricated component in aluminum in a pressure die casting tool. However, such a production method has not found acceptance in actual use because problems encountered in the two-step process have not been satisfactorily solved. For example, the fiber guide conduit prefabricated from sheet steel typically deforms in the pressure diecasting tool because of the high pressure and, therefore, the fiber guide conduit must be elaborately supported in the die cast tool. In addition, there is a continuous and significant risk that liquid casting material will penetrate into the fiber guide conduit, thereby causing detrimental results to surface quality.

Finally, two-piece fiber guide conduits am known from German Patent Publications DE 39 22 060 A1 and DE 29 27 294 A1, wherein the fiber inlet portion of the fiber guide conduit is arranged in an insert, which is displaceably seated in the opening roller housing. The inserts, embodied as die cast pies, have a very simple geometric shape in order to avoid difficulties during production and assembly, and therefore cannot meet the requirements of spinning technology.

OBJECT AND SUMMARY OF THE INVENTION

Based on the above mentioned prior art it is an object of the invention to provide an open-end spinning unit that meets the requirements of spinning technology and can be manufactured in a cost-effective and efficient manner. The present invention is especially advantageous with respect to cost-effective manufacturing as well as to spinning technology efficiency.

Briefly described, the open-end spinning unit of the present invention comprises a rotor housing, an opening roller housing, a fiber guide conduit disposed between and interconnecting the rotor housing with the opening roller housing for transporting fibers from the opening roller housing to the rotor housing, with the fiber guide conduit being removably mounted in the rotor housing and opening roller housing, and sealing components disposed at each mounting location for releasably sealing the engagement of the fiber guide conduit with the rotor housing and the opening roller housing. The opening roller housing has an opening roller rotatably disposed therein for opening fibers from an incoming silver and the rotor housing includes a rotor rotatably disposed therein for the spinning of opened fibers into yarn. The opened fibers are transported by the fiber guide conduit from the opening roller to the rotor for spinning into yarn.

Preferably, the production of the fiber guide conduit is by cold forming, i.e., by drawing from a steel tube, which results in the production of an integral one-piece component which has a very smooth interior surface and which exhibits optimized cross-sectional contours. A fiber guide conduit manufactured in this way can be used with a pressure die cast opening roller housing without the aforementioned problems, providing it can be sufficiently mounted to the opening roller housing and the rotor housing so as to preserve pressure differentials and the pneumatic conveyance of opened fibers therebetween. The present invention accomplishes this through the unique mounting and sealing of the fiber conduit guide with the opening roller housing and rotor housing.

The integral one-piece construction of the fiber guide conduit provides a fiber inlet portion for receiving the opened fibers from the opening roller and a fiber outlet portion for delivering the opened fibers to the rotor. As previously mentioned, the fiber guide conduit is constructed by cold forming, i.e., drawing from a steel tube. The fiber guide conduit further preferably includes a beveled edge portion of the fiber inlet portion positionable adjacent the opening roller which is protected against wear by mineral dust and fibers that cling to the opening roller.

The fiber guide conduit is mounted within the opening roller housing at a first mounting location that includes an opening through which the fiber guide conduit extends. The fiber guide conduit is releasably mounted within the opening so that it can be both easily withdrawn and inserted as needed. The fiber guide conduit is mounted within the rotor housing at a second mounting location that includes an opening through which the fiber outlet portion extends. The fiber guide conduit is also releasably mounted within the second mounting location opening so that it can be both easily withdrawn and inserted as needed.

Preferably, the first mounting location comprises a seating recess formed in the opening roller housing which defines the opening of the first mounting location and a passage which communicates with the opening roller. The passage is disposed adjacent the opening and is also disposed adjacent a fiber inlet portion when inserted into the seating recess. The passage communicates entirely with an inserted fiber inlet portion for uniterrupted transport of opened fibers from the passage into the fiber guide conduit. The opening as defined by the seating recess conforms to the external cross-section of the fiber inlet portion of the fiber guide conduit inserted therein in order to provide a tight-fitted mounting of the fiber conduit guide within the seating recess. The passage, on the other hand, has a cross-section that is smaller than the external cross-section of the fiber inlet portion by at least one wall thickess of the fiber inlet portion. Hence, the junction of the opening, which conforms to the fiber inlet portion, and the passage, which is smaller, forms a shoulder upon which the fiber inlet portion abuts in resting engagement. Furthermore, because the passage is disposed adjacent the fiber inlet portion and communicates entirely with the fiber inlet portion, there is uninterrupted transport of opened fibers from said passage into said fiber guide conduit.

While the fiber inlet portion may be securely mounted at the first mounting location by its tight-fitted engagement within the opening defined by the seating recess and its abutment in resting engagement with the shoulder, nevertheless, the fiber inlet portion preferably is further secured by a cover plate attached to the opening roller housing that covers the seating recess. The cover plate includes a passage itself through which the fiber guide conduit extends. The passage in the cover plate conforms to the fiber guide conduit extending therethrough for a tight-fitted mounting.

With respect to the second mounting location, the rotor housing preferably includes a plate for sealing in airtight engagement the rotor within the rotor housing. A bore is included in the sealing plate through which the fiber outlet portion is extendable for communication with the rotor. The bore conforms to the contours of the fiber guide conduit extending therethrough for a tight-fitted mounting of the fiber guide conduit within the sealing plate attached to the rotor housing.

To maintain an air-tight environment between the opening roller housing and the rotor housing, sealing components are provided at the first and second mounting locations for releasably sealing the fiber guide conduit with the opening roller housing and the rotor housing. With respect to the first mounting location, preferably the sealing component is adaptable to conform to the external contour of the fiber inlet portion and is dispoasble in the seating recess of the first mounting location. Furthermore, the sealing component preferably includes an O-ring for sealing engagement of the fiber inlet portion with the opening roller housing, with the O-ring being partially disposed in a sealing groove in the seating recess. With respect to the second mounting location, the sealing component preferably comprises a sealing nozzle disposed on the fiber conduit guide in abutment with the sealing plate of the rotor housing.

BRIEF DESCRIPTION OF THE DRAWINGS

FIG. 5 is a cross-sectional view similar to FIG. 3, showing an alternative embodiment of an opening roller housing and a fiber guide conduit according to the present invention;

FIG. 6 is a front cross-sectional view similar to FIG. 4 showing the opening roller housing and the fiber guide conduit of FIG. 5;

FIG. 7 is a lengthwise cross-sectional view a fiber guide conduit of the present invention drawn from a steel tube;

FIG. 8 is a front elevational view of the fiber guide conduit of FIG. 7; and

FIG. 9 is a top plan view of the fiber guide conduit of FIG. 7 and 8.

DETAILED DESCRIPTION OF THE PREFERRED EMBODIMENTS

Figure 2:
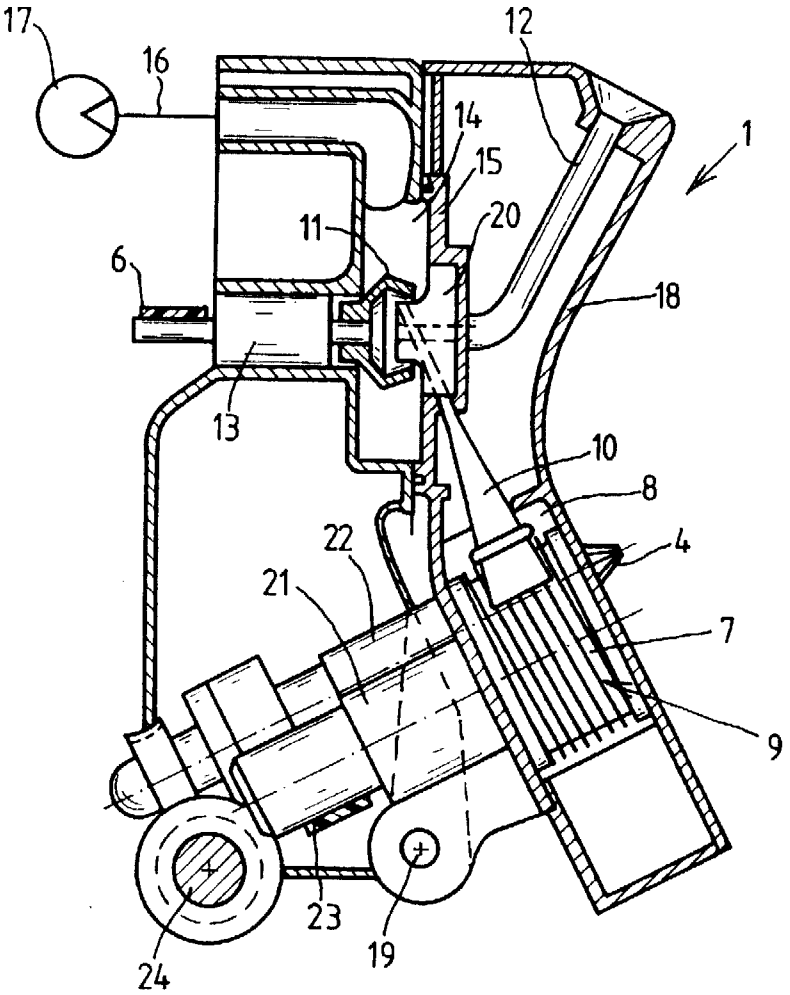
FIG. 2 is a vertical cross-sectional view of the open-end spinning unit of FIG. 1.
Figure 1:
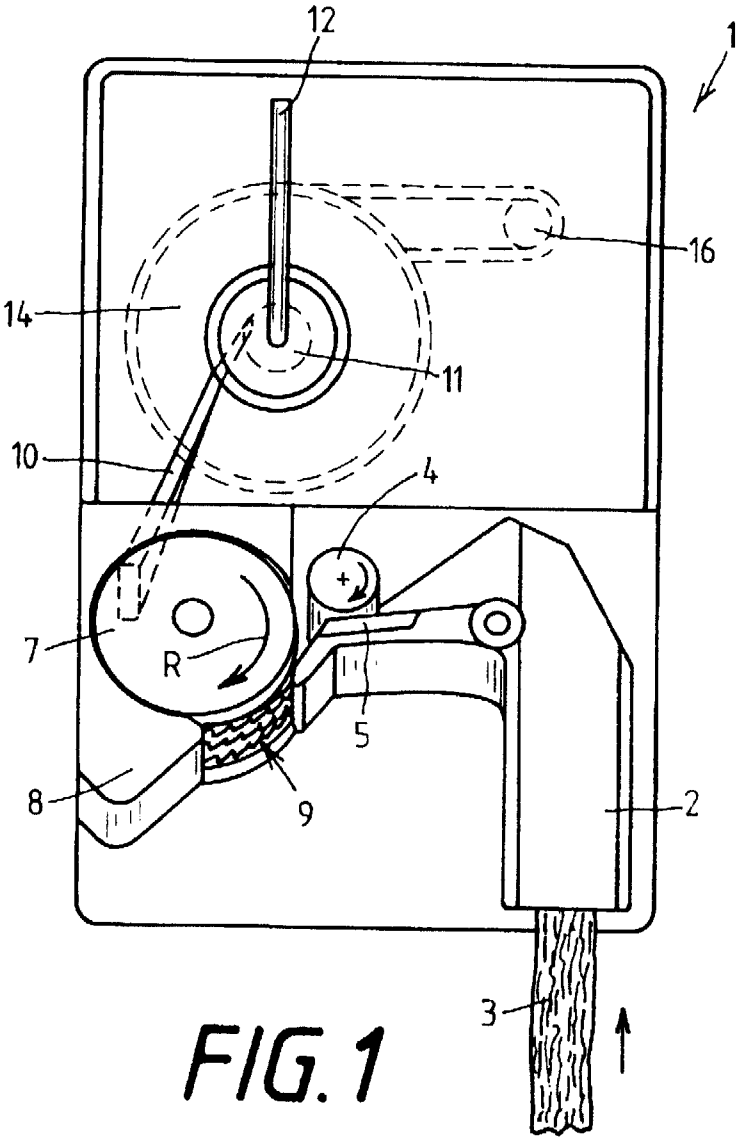
FIG. 1 is a front elevational view of an open-end rotor spinning unit with a one-piece fiber guide conduit inserted between the opening roller housing and the rotor housing in accordance with the present invention.

An open-end rotor spinning unit according to the present invention is generally illustrated at 1 in FIGS. 1 and 2. In such spinning units, a silver 3 is introduced via a condenser 2 into the spinning unit 1. The silver 3 is fed by a draw-in roller 4, against which a feed trough 5 integrated into the condenser 2 presses, to an opening roller 7 rotating in the direction R. The opening roller 7, which is partially enclosed by an opening roller housing 8, opens the presented silver 3 by means of its saw-tooth fitting 9 into individual fibers (not shown), which are subsequently pneumatically conveyed via the fiber guide conduit 10 to a spinning rotor 11. The individual fibers are centrifugally spun into a yarn in the spinning rotor 11, which is drawn out of the spinning unit via a draw-off device 12.

As can be see in particular from FIG. 2, the opening roller 7 is seated in a bearing 21 and the draw-in roller 4 is seated in a bearing 22, with each roller 4,7 being disposed in a cover 18 that encloses and protects the spinning process. The opening roller 7 is driven via a tangential belt 23 and the draw-in roller 4 is driven via a drive shaft 24.

With further reference to FIG. 2, the spinning rotor 11 is seated in a rotor bearing 13 and driven by means of a tangential belt 6 to rotate in a rotor housing 14, which is closed off in airtight engagement at its front by means of a sealing plate 15. The sealing plate 15 is fastened on the cover 18 which is pivotably disposed on a pivot shaft 19. A conduit plate adapter 20 is interchangeably disposed in a recess of the sealing plate 15 and allows a simple adaptation of the spinning unit to different materials and therefore different rotor diameters.

During the yarn production process the rotor housing 14 is continuously connected with a vacuum source 17 via a line 16. This creates a pressure differential between the opening roller housing 8 and the rotor housing 14, which produces the pneumatic conveyance of the opened fibers through the fiber guide conduit 10 between the opening roller housing 8 and the rotor housing 14. Sealing plate 15 serves to maintain the low pressure condition within the rotor housing 14 for inducing pneumatic fiber conveyance.

The fiber guide conduit 10 of the present invention is shown in detail in FIGS. 7 to 9 and includes a fiber inlet portion 33 and a fiber outlet portion 34. The fiber guide conduit 10 is preferably drawn from a steel tube as a one-piece component. In an optimal configuration, the cross-section of the fiber outlet portion 34 and the cross-section of the fiber inlet portion 33 of the fiber guide conduit 10, do not exceed a ratio of 1:4. Furthermore, the fiber guide conduit 10 has an essentially rectangular cross-section in the fiber inlet portion 33, a conical cross-section extending away from the fiber inlet portion 33, and finally a circular cross-section in the fiber outlet portion 34. Therefore, with an interior diameter D of the fiber outlet portion 34 of, for instance, 6 mm (28.26 $mm^2$ cross-sectional area), the fiber inlet portion cross-sectional area is no greater than 113 $mm^2$. Thus, with a width B of the fiber inlet portion 33 of 22 mm, which is determined by the dimensions of the opening roller 7, the conduit height H within the fiber inlet portion 33 is 5.1 mm.

Figure 4:
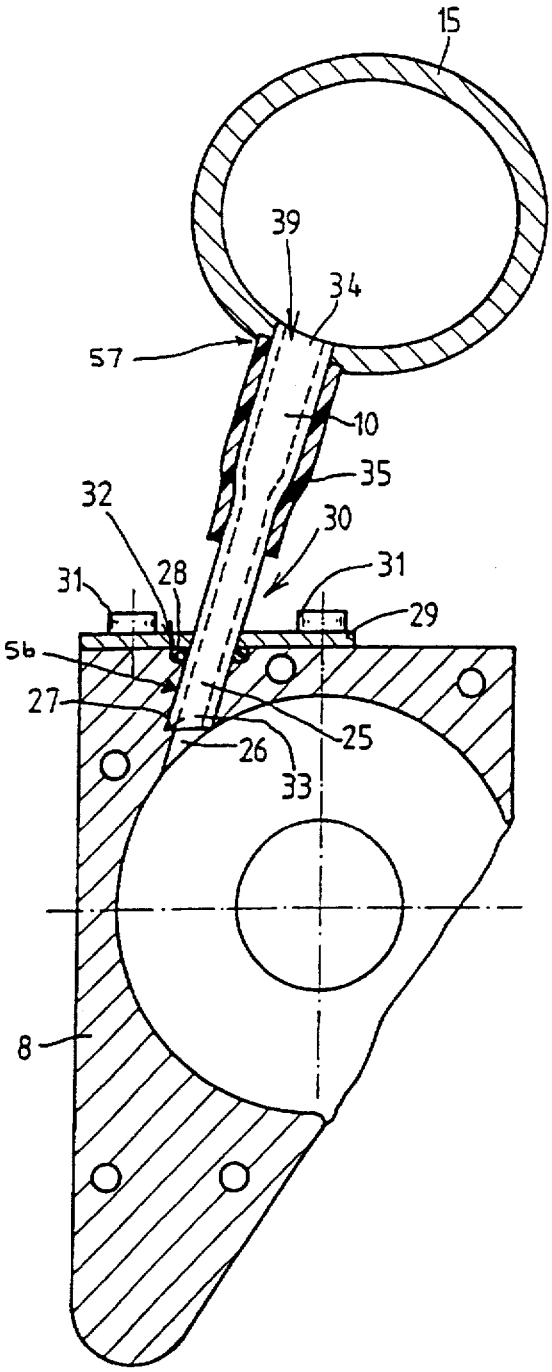
FIG. 4 is a front cross-sectional view of the opening roller housing and the fiber guide conduit of FIG. 3.

A fiber guide conduit wall 37 in the fiber inlet portion 33, as illustrated in FIG. 7, has a beveled edge portion 38 for disposition adjacent the opening roller 7, as illustrated in FIGS. 4 and 6. The beveled edge portion 38 is protected against wear by means of hardening or an appropriate coating. Thus, the fiber inlet portion 33 is protected from debris and rotating fibers that cling to the opening roller 7 when rotating (not shown).

Figure 3:
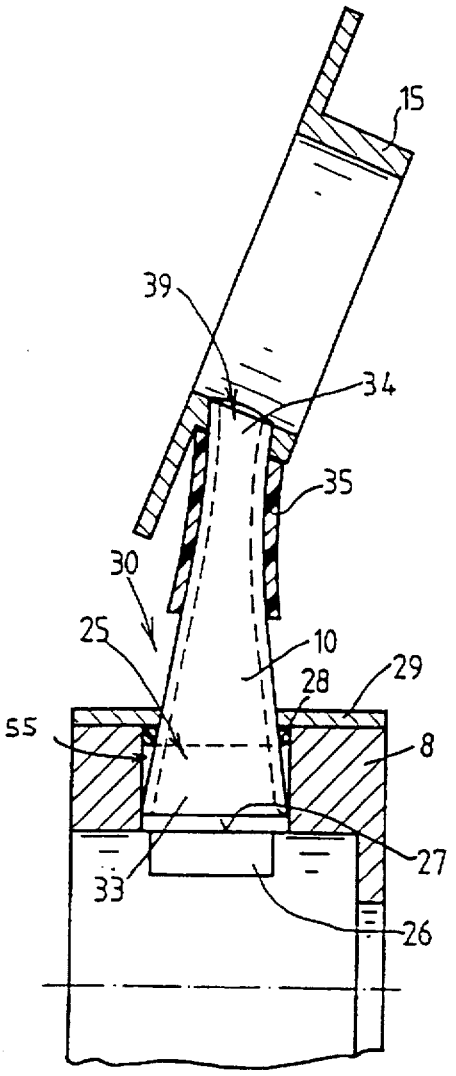
FIG. 3 is a more detailed cross-sectional view of the opening roller housing and the inserted fiber guide conduit of FIG. 2.

Now referring to one preferred embodiment of the invention illustrated in FIGS. 3 and 4, the opening roller housing 8 has a first mounting location 25 having an opening 55 for insertion of the fiber guide conduit 10. The opening roller housing 8 is preferably constructed by a die casting process whereby the first mounting location 25 is formed. Because of the dose tolerances which can be achieved in a pressure diecasting process, there is no requirement for further processing of the opening roller housing 8, particularly the first mounting location 25 and the opening 55 therein. However, it is also possible in principle to form the first mounting location opening 55 by machining after die casting of the opening roller housing 8. In either case, the dimensions of the opening 55 in the first mounting location 25 should conform to the exterior cross-section of the fiber inlet portion 33 of the fiber guide conduit 10.

Preferably, the opening 55 at the first mounting location is formed as a stepped bore through the opening roller housing 8; the bore having an enlarged outwardly opening seating recess 56 which defines the opening 55 by that has a cross-section conformed to the cross-section of the fiber inlet portion 33 of the fiber guide conduit 10, and a narrow passage 26 having a cross-section that is smaller than that of the opening 55 at least one wall thickness of the fiber inlet portion. The passage 26 opens completely into the interior of the fiber inlet portion 33 of the fiber guide conduit 10. Such a design assures that no disrupting transitions occur in the pneumatic fiber conveyance between the passage 26 and the fiber inlet portion 33, as all opened fibers traveling through the passage 26 continue traveling into the fiber guide conduit 10 uninterrupted. Furthermore, this design makes it possible to define the exact position of the fiber guide conduit 10, and more specifically the fiber inlet portion 33, in the opening roller housing 8 because the shoulder 27 creates a stop-surface in the seating recess 56 due to the varying widths between the opening 55 and the passage 26. As can be seen from FIG. 4, the shoulder 27 created at the transition between the opening 55 and the passage 26 serves to engage and support the end of the fiber guide conduit 10 when inserted into the opening 55 at the first mounting location.

Sealing in airtight fashion of the fiber guide conduit 10 inside the seating recess 56 can be performed by inexpensive means such as O-rings or sealing nozzles. This insures that an airtight environment and low pressure condition is maintained between the rotor housing 14 and the opening roller housing 8, and that the opened fibers in the opening roller housing 8 will be efficiently pneumatically transported therefrom to the rotor housing 14. By way of an example, an O-ring form of sealing means 28 which seals the fiber guide conduit 10 with the opening roller housing 8 at the first mounting location 25 is illustrated in FIGS. 3 and 4. Preferably, the O-ring 28 and is at least partially positioned in a sealing groove 32 formed in opening 55 by housing 8 as indicated in FIG. 4.

A further preferred feature of the present invention includes a cover plate 29 that can be attached to the opening roller housing 8 having a passage 30 which conforms to the exterior cross-section of the fiber guide conduit 10 to be inserted therethrough. The first mounting location opening 25 is shown in FIGS. 3 and 4 closed off by the cover plate 29. The cover plate 29 has an outlet opening 30 conformed to the exterior configuration and dimensions of the installed fiber guide conduit 10 for a tight-fitted mounting disposition, and the cover plate 29 can be fixed in place on the opening roller housing 8 by suitable fastening means 31, as for example threaded bolts.

A second mounting location 57 is formed in the rotor housing through which the fiber guide conduit 10 communicates with the rotor 11. Preferably, the second mounting location 57 is formed in the sealing plate 15. Like the first mounting location, the second mounting location 57 can be constructed in a die cast process by forming an opening in the plate 15 for receiving the fiber outlet portion 34 of the fiber guide conduit 10 into the rotor housing 14. Preferably, the second mounting location 57 comprises a bore 39 formed in the sealing plate 15 during the die cast process. The fiber outlet portion 34 also preferably has a circular cross-section. The sealing of the fiber outlet portion 34 through the sealing plate 15 is accomplished through an inexpensive sealing nozzle 35 disposed on the fiber guide conduit in abutment with the rotor housing, as illustrated in FIGS. 3 and 4.

Thus, fiber guide conduit 10 has its fiber inlet area 33 fixed in place in the seating recess 25, and has its fiber outlet portion 34 fixed in place in bore 39 of the sealing plate 15. The low pressure condition within the fiber guide conduit 10 and the pressure differential between the rotor housing 14 and opening roller housing 8 is, maintained by the O-ring 28 in the first mounting location and the sealing nozzle 35 at the second mounting location 39.

In an alternative embodiment of the present invention, the opening roller housing comprises two mating housing members separated by a parting line, as illustrated in FIGS. 5 and 6. Preferably, the parting line extends through the seating recess. Such a design has the important advantage that the contour of the opening of the seating recess can be matched exactly with the exterior shape of the fiber guide conduit in this area, which is typically conical, since with such an embodiment the insertion of the fiber guide conduit into the seating recess is possible from the front of the spinning unit (as viewed in FIG. 1). As shown in FIG. 6, the opening roller housing 8 consists of two individual housing members **8*a* and 8*b*; the parting line is indicated by 36. Thus, the opening 55 and passage 26 are accessible from the front of the spinning unit and therefore can be exactly adapted in this area to the conical contour of the fiber guide conduit 10. Consequently, the opening 55 has a conical shape which exactly corresponds to the outer contour of the fiber guide conduit 10. A sealing groove 32 is formed in the seating recess 56, into which sealing means 28, for example an O-ring, can be inserted. Furthermore, because of the tight-fit between the fiber guide conduit 10 and the seating recess 56 in this embodiment, the mounting is airtight and the cover plate 29** can be omitted.

Altogether, the embodiment in accordance with the invention of an open-end rotor spinning unit results in a dependable operating spinning device which can be cost-effectively produced and maintained. The fiber guide conduit can be easily assembled in and disassembled from the spinning unit. Furthermore, the assembly allows the fiber conduit guide to be independently constructed by cold drawing from a steel tube, which allows optimization of the fiber guide conduit for spinning operations. Efficient pneumatic conveyance of the opened fibers is maintained by the inexpensive O-ring and sealing nozzle as well as the sealing plate. Furthermore, when the opening roller housing comprises two housing members, the seating recess opening can be formed to exactly match the fiber guide conduit, thereby creating an airtight mount and further making the cover plate unnecessary.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed:

1. An open-end spinning unit, comprising:

a rotor housing having a rotor rotatably disposed therein for spinning fibers into yarn, an opening roller housing having an opening roller rotatably disposed therein for converting sliver into fibers, a fiber guide conduit disposed between and interconnecting said rotor housing and said opening roller housing for transporting opened fibers from said opening roller housing to said rotor housing, said fiber guide conduit being of a one-piece integrally formed component comprising a fiber inlet portion for receiving opened fibers from said opening roller and a fiber outlet portion for delivering the opened fibers to said rotor, said opening roller housing defining a first mounting location having an opening through which said fiber inlet portion of said fiber guide conduit extends for receiving opened fibers from said opening roller, said fiber inlet portion being releasably mountable at said first mounting location, said rotor housing defining a second mounting location having an opening through which said fiber outlet portion of said fiber guide conduit extends for delivering fibers to said rotor, said fiber outlet portion being releasably mountable at said second mounting location, and means at said first and said second mounting locations for releasably sealing in airtight engagement said fiber inlet portion and said fiber outlet portion of said fiber guide conduit to said opening roller housing and to said rotor housing, respectively, wherein said fiber conduit guide is easily disassembled from and assembled into the spinning unit by releasing and engaging said sealing means and withdrawing therefrom and inserting therein said fiber guide conduit, respectively.

2. An open-end spinning unit according to claim 1, wherein said fiber guide conduit is drawn from the steel tube.

3. An open-end spinning unit according to claim 1, wherein said first mounting location comprises a seating recess that includes said first mounting location opening and a passage which communicates with said opening roller, said passage being disposed adjacent said fiber inlet portion and communicating entirely with said fiber inlet portion for uninterrupted transport of opened fibers from said passage into said fiber guide conduit.

4. An open-end spinning unit according to claim 3, wherein said opening of said seating recess is configured to correspond to the external cross-section of said fiber inlet portion of said fiber guide conduit, thereby providing a tight-fitted mounting of said fiber guide conduit in said seating recess.

5. An open-end spinning unit according to claim 4, wherein said passage has an external cross-section that is smaller than the external cross-section of said fiber inlet portion by at least one wall thickness of said fiber inlet portion.

6. An open-end spinning unit according to claim 5, wherein a junction of said passage and said opening define a shoulder against which said fiber inlet portion of said fiber guide conduit abuts in resting engagement.

7. An open-end spinning unit according to claim 3, wherein said sealing means is adaptable to conform to the external contour of said fiber inlet portion, and said sealing means is positionable in said seating recess of said first mounting location.

8. An open-end spinning unit according to claim 7, wherein said sealing means includes an O-ring for sealing engagement of said fiber guide conduit with said opening roller housing, and wherein said opening roller housing defines a sealing groove in said seating recess, said O-ring being partially disposed in said sealing groove.

9. An open-end spinning unit according to claim 1, wherein said fiber inlet portion is further secured at said first mounting location by a cover plate attachable to said opening roller housing, said cover plate enclosing said first mounting location and having a passage that conforms to said fiber guide conduit so that said fiber guide conduit extends therethrough in tight-fitted mounting disposition.

10. An open-end spinning unit according to claim 1, wherein said opening roller housing is formed by two housing members joined along a parting line that extends between said portions and through said first mounting location.

11. An open-end spinning unit according to claim 10, wherein said first mounting location comprises a seating recess that includes said first mounting location opening and a passage which communicates with said opening roller, said seating recess conforming to the contours of said fiber guide conduit, said passage being disposed adjacent said fiber inlet portion and communicating entirely with said fiber inlet portion for uninterrupted transport of opened fibers from said passage into said fiber guide conduit.

12. An open-end spinning unit according to claim 1, wherein said fiber inlet portion disposed adjacent said opening roller further comprises a beveled edge portion that is protected against wear from debris and fibers on said opening roller.

13. An open-end spinning unit according to claim 1, wherein said rotor housing includes a sealing plate for sealing in airtight engagement said rotor within said rotor housing, said second mounting location comprising a bore in said plate for mounting said fiber outlet portion therein in communication with said rotor, said bore conforming to said fiber outlet portion and communicating with said rotor, said sealing means for said fiber outlet portion comprising a sealing nozzle disposed on said fiber guide conduit against said sealing plate.

14. An open-end spinning unit, comprising:

a rotor housing having a rotor rotatably disposed therein for spinning fibers into yarn, and a sealing plate for sealing in airtight engagement said rotor within said rotor housing, an opening roller housing having an opening roller rotatably disposed therein for converting silver into fibers, said opening roller housing being formed by two members joined along a parting line, a fiber guide conduit disposed between and interconnecting said rotor housing and said opening roller housing for pneumatically conveying opened fibers from said opening roller housing to said rotor housing, said fiber guide conduit being of a one-piece integrally formed component drawn from a steel tube and comprising a fiber inlet portion for receiving opened fibers from said opening roller and a fiber outlet portion for delivering the opened fibers to said rotor, said fiber guide inlet portion being disposed adjacent said opening roller and including a beveled edge portion that is protected against wear by mineral dust and fibers clinging to the opening roller, said opening roller housing defining a first mounting location comprising a seating recess that includes an opening and a passage which communicates with said opening roller, said fiber inlet portion of said fiber guide conduit extending through said opening for receiving opened fibers from said opening roller through said passage, said opening being dimensioned to correspond to the external cross-section of said fiber inlet portion of said fiber guide conduit thereby providing a tight-fitted releasable mounting of said fiber guide conduit in said seating recess, said passage being disposed adjacent said fiber inlet portion and communicating entirely with said fiber inlet portion for uninterrupted pneumatic conveyance of opened fibers from said passage into said fiber guide conduit, said passage having an external cross-section that is smaller than the external cross-section section of said fiber inlet portion by at least one wall thickness of said fiber inlet portion a the junction of said passage and said opening defining a stop-shoulder against which said fiber inlet portion of said fiber guide conduit abuts in resting engagement, said fiber inlet portion being further secured at said first mounting location by a cover plate attachable to said opening roller housing, said cover plate enclosing said first mounting location and having a passage that conforms to the dimensions of said fiber guide conduit so that said fiber guide conduit extends therethrough in tight-fitted disposition, said parting line between said two housing members extending through said first mounting location, said rotor housing defining a second mounting location comprising a bore in said sealing plate for releasably mounting said fiber outlet portion therein, said bore conforming to the contours of said fiber outlet portion and communicating with said rotor, said fiber outlet portion of said fiber guide conduit extending through said bore for delivering fibers to said rotor, said fiber outlet portion being releasably mountable at said second mounting location, and means at said first and said second mounting locations for releasably sealing in airtight connection said fiber inlet portion and said fiber outlet portion of said fiber guide conduit to said opening roller housing and rotor housing, respectively, said sealing means including an O-ring adaptable to conform to the external contour of said fiber inlet portion and disposable in said seating recess of said first mounting location, said opening roller housing defining a sealing groove in said seating recess in which said O-ring is partially disposable for sealing engagement of said fiber inlet portion with said opening roller housing, said sealing means for said fiber outlet portion comprising a sealing nozzle disposed against said rotor housing on said fiber guide conduit, wherein said fiber conduit guide is easily disassembled from and assembled into the spinning unit by releasing and engaging said sealing means and dismounting and mounting said fiber guide conduit, respectively.

15. An open-end spinning unit having a rotor rotatably disposed in a rotor housing that is closed off airtight by means of a sealable plate, an opening roller housing having an opening roller rotatable therein, and a one-piece fiber guide conduit inserted between the opening roller and the sealable plate, characterized in that:

the fiber guide conduit is an interchangeably disposed component drawn from a steel tube, the fiber guide conduit is releasably disposed in said opening roller housing and the fiber guide conduit is releasably disposed in a bore in the sealable plate; and sealing means are provided which assure an airtight connection of the fiber guide conduit both with said opening roller housing and with said sealable plate.

* * * * *